US007673958B2

(12) United States Patent
Heiles et al.

(10) Patent No.: US 7,673,958 B2
(45) Date of Patent: Mar. 9, 2010

(54) DEFECTIVE IMAGING ELEMENT COMPENSATION

(75) Inventors: Tod Heiles, Vancouver, WA (US); Wayne Michael Richard, San Diego, CA (US); David W. Kinkley, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1214 days.

(21) Appl. No.: 11/157,724

(22) Filed: Jun. 21, 2005

(65) Prior Publication Data

US 2006/0284916 A1 Dec. 21, 2006

(51) Int. Cl.

| | |
|---|---|
| ***B41J 29/393*** | (2006.01) |
| ***B41J 29/38*** | (2006.01) |
| ***B41J 2/165*** | (2006.01) |
| ***B41J 2/21*** | (2006.01) |

(52) U.S. Cl. ..... 347/19; 347/12; 347/22; 347/43

(58) Field of Classification Search ..... 347/43, 347/12, 19, 22

See application file for complete search history.

(56) References Cited

U.S. PATENT DOCUMENTS

| | | | |
|---|---|---|---|
| 6,010,205 | A | 1/2000 | Billet |
| 6,089,693 | A | 7/2000 | Drake et al. |
| 6,203,140 | B1 | 3/2001 | Oyen |
| 6,238,112 | B1 | 5/2001 | Girones et al. |
| 6,270,187 | B1 | 8/2001 | Murcia et al. |
| 6,302,511 | B1 | 10/2001 | Neese |
| 6,454,392 | B1 | 9/2002 | Lopez et al. |
| 6,575,549 | B1 | 6/2003 | Silverbrook |
| 6,863,361 | B2 | 3/2005 | Barr et al. |
| 2002/0051144 | A1 | 5/2002 | Ilbery et al. |
| 2002/0101602 | A1 | 8/2002 | Vilanova et al. |
| 2003/0112292 | A1 | 6/2003 | Lee |
| 2003/0142158 | A1 | 7/2003 | Lee |
| 2003/0142162 | A1 | 7/2003 | Barr et al. |
| 2003/0174187 | A1 | 9/2003 | Greive |
| 2004/0032438 | A1 | 2/2004 | Silverbrook |
| 2004/0046811 | A1 | 3/2004 | Souza |

FOREIGN PATENT DOCUMENTS

| | | |
|---|---|---|
| EP | 0694396 | 1/1996 |
| EP | 1308280 | 5/2003 |
| WO | WO 97/31781 | 9/1997 |

OTHER PUBLICATIONS

European Search Report dated Oct. 11, 2006 for EP patent application No. EP 06010696, 4 pages.

*Primary Examiner*—Matthew Luu
*Assistant Examiner*—Jannelle M Lebron

(57) ABSTRACT

A method for forming an image with at least one linear array of imaging elements. Defective ones of the imaging elements associated with a particular color are detected. A first defective imaging element compensation operation is performed for portions of the image data that are associated with a first predetermined number or fewer adjacent defective imaging elements. A different second defective imaging element compensation operation is performed for portions of the image data that are associated a second predetermined number or more adjacent defective imaging elements.

28 Claims, 12 Drawing Sheets

Continuous-tone: $o_N$, $e_N$, $r_N$ = 0..255

Halftone: $e_N$, $r_N$ = 0..3

DEFECTIVE IMAGING ELEMENT COMPENSATION

BACKGROUND OF THE INVENTION

As the use of printers for printing images such as text, graphics, and photos has become widespread, it has become desirable to obtain high quality print output as quickly as possible. One way to obtain faster print output is to print each portion of the print medium using only a single pass. In single pass printing, the print elements and the print medium are moved relative to each other in such a way that the print elements are positioned adjacent a given region of the print medium only once during printing.

To achieve high quality results, it has become common for printing elements to be tightly packed together, with densities of 300, 600, or more print elements per inch. At such densities, it is not uncommon for particular print elements to be, or to become, defective. Defective print elements typically produce visible defects on the printed medium that degrade print quality. Such undesirable defects may include, for example, white or different-colored lines or streaks, which are often more noticeable in regions of uniform color. To compensate, some printers may use multiple pass printing, which minimizes such streaks by overprinting the same region of the print medium with non-defective print elements, but a multiple pass printing mode disadvantageously increases print time and decreases throughput.

Other image-forming devices, such as pixel-addressable displays and digital light processing (DLP) projectors, can also have imaging elements (elements that form a portion of the image) that are defective, and thus exhibit undesirable defects in the quality of the displayed or projected image.

For these and other reasons, there is a need for the present invention.

BRIEF DESCRIPTION OF THE DRAWINGS

The features of the present invention and the manner of attaining them, and the invention itself, will be best understood by reference to the following detailed description of embodiments of the invention, taken in conjunction with the accompanying drawings, wherein.

DESCRIPTION OF THE PREFERRED EMBODIMENT

Figure 1:
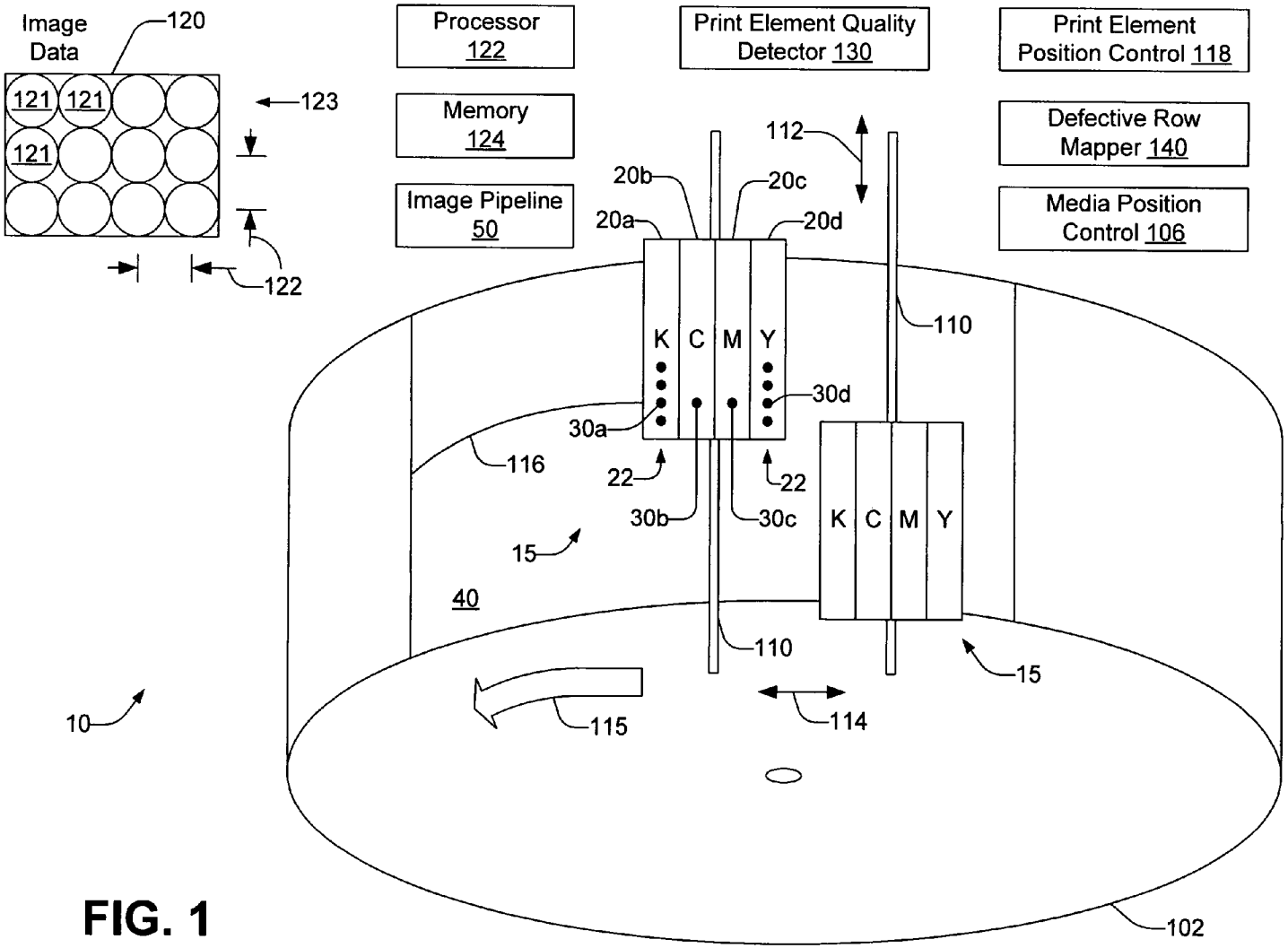
FIG. 1 is a schematic representation of a printer in accordance with an embodiment of the present invention.

Referring now to the drawings, there is illustrated an embodiment of an image forming apparatus, specifically a printer, constructed in accordance with the present invention that achieves high throughput via single pass printing and that also minimizes undesirable print quality degradation due to defective print elements. A print element quality detector identifies defective print elements, and an image data to print element mapper identifies pixels that would otherwise be printed with the defective print elements. In one embodiment, groups of adjacent defective print elements are identified, and the identified pixels are processed by different compensation techniques, depending on the number of adjacent defective print elements in the group, in order to minimize the undesirable print quality degradation. One embodiment of a compensation technique employs a replacement color map to change an original color value to a replacement color value of substantially equivalent lightness that does not use a defective print element.

A variety of printers are commercially available. For instance, some of the printing devices in which the present invention, described below, may be embodied include inkjet printers, plotters, portable printing units, copiers, cameras, video printers, laser printers, facsimile machines, and all-in-one devices (e.g. a combination of at least two of a printer, scanner, copier, and fax), to name a few. Such printers may form color images, such as text, graphics, and photographs, on a print medium that may be any type of suitable sheet or roll material, such as paper, card stock, cloth or other fabric or textile, transparencies, plastics such as mylar, and the like. But for convenience, the illustrated embodiments are described using paper as the print medium.

As can be understood with reference to FIG. 1, one embodiment of a printer 10 includes a media movement mechanism such as rotatable drum 102 and one or more printhead arrangements 15. Each printhead arrangement 15 may include one or more printheads 20, such as printheads 20*a-d*. A printhead 20 typically includes a logically linear array of print elements 22. Each printhead arrangement 15 is movable via slider bar 110 along an axis 112 orthogonal to the direction 114 of movement of a print medium 40 mounted to the drum 102 as it rotates in direction 115 as controlled by media position control mechanism 106.

Figure 2:
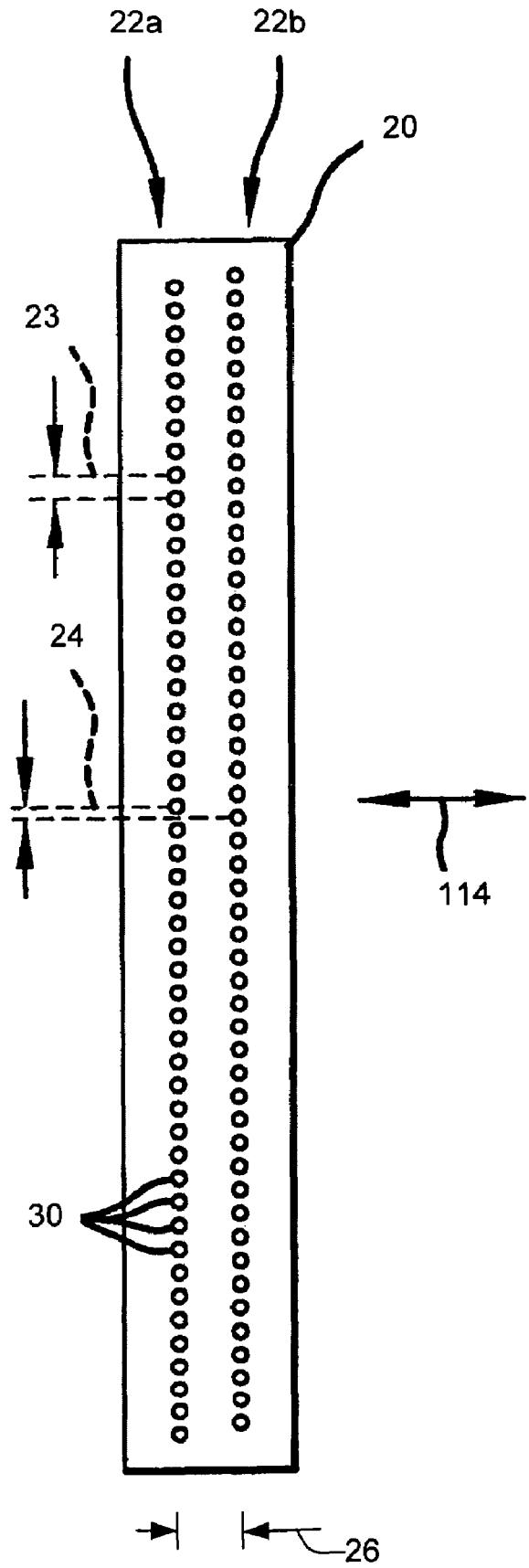
FIG. 2 is a schematic representation of the printing elements of a printhead usable with the printer of FIG. 1 according to an embodiment of the present invention.
Figure 3:
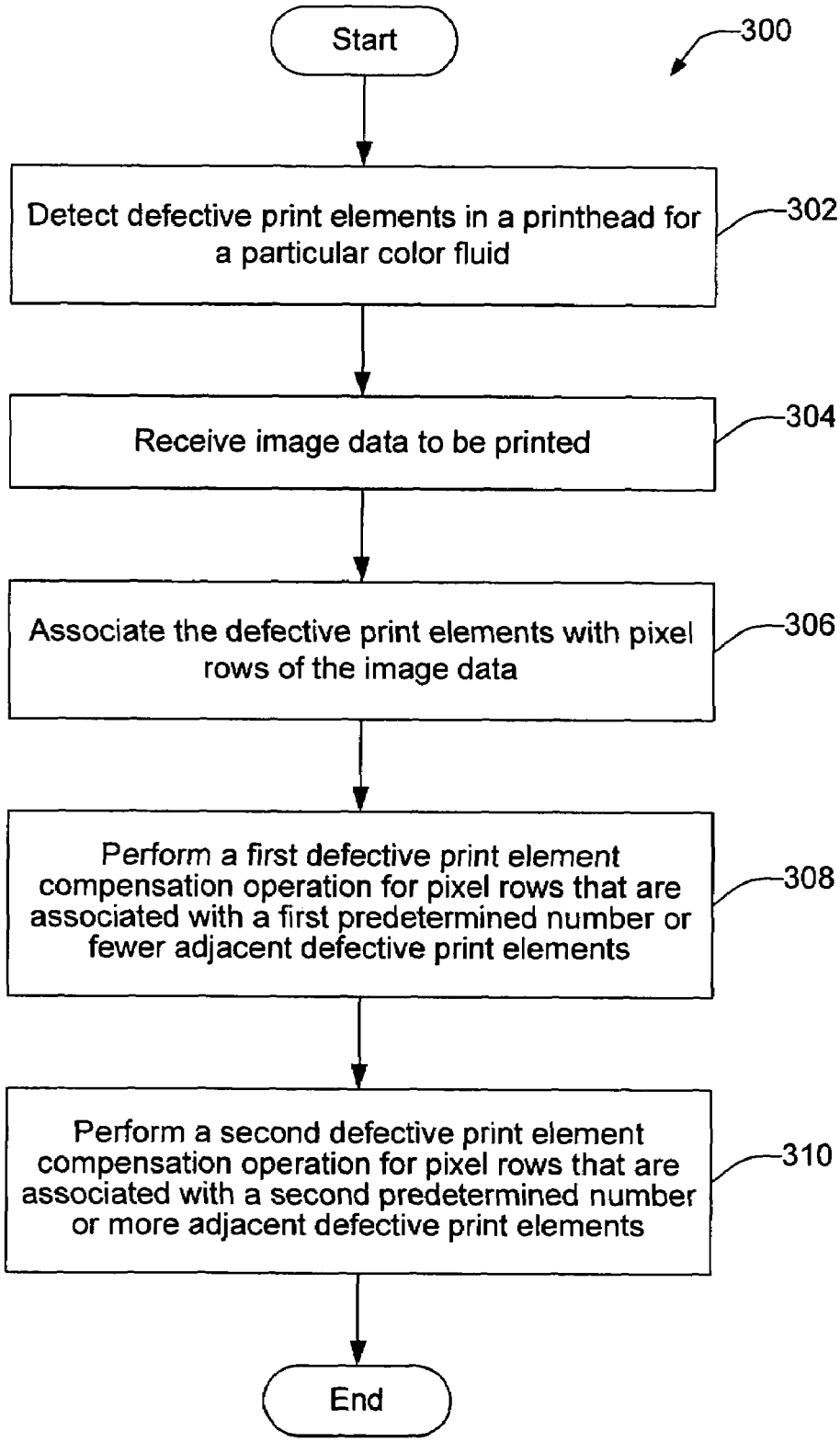
FIG. 3 is a flowchart of one embodiment of a printing method in accordance with the present invention.

Considering printhead 20 in greater detail, and with reference to FIG. 2, one embodiment of printhead 20 has two vertical columns 22*a-b* of print elements 30 which, when the printhead 20 is installed in the printer 10, are parallel to direction 112. The columnar vertical spacing 23 between adjacent print elements in a column may be, for example, $1/300^{th}$ inch. However, by using two columns instead of one and logically treating the print elements as a single linear column, the effective vertical spacing 24 between logical print elements is reduced to, for example, $1/600^{th}$ inch, thus achieving improved printing resolution. Printing at a corresponding $1/600^{th}$ inch spacing may be achieved, for example, by emitting ink from one column 22*a* or 22*b* of the print elements, then rotating the drum 102 the inter-column distance 26 before emitting ink from the other column.

Returning now to consider further the usage of printheads 20 in printer 10, and with reference again to FIG. 1, the printheads 20 in printhead arrangement 15 may be configured to emit drops of different colored fluids, such as pigment-based or dye-based colored inks. In the illustrated embodiment, there are four printheads 20*a-d* which deposit black (K), cyan (C), magenta (M), and yellow (Y) inks respectively. The colors corresponding to the fluids may be referred to as base colors.

By emitting an appropriate number of drops of the inks onto corresponding locations of the print medium 40, text, graphics, and photographic images corresponding to image data 120 sent to printer 10 can be printed with a high level of quality. Printheads 20*a-d* may be disposed in printhead arrangement 15 such that print elements 30*a-d* are all capable of depositing ink drops on a same location of print medium 40. Ink drops of two or more of the base colors may be overprinted on a same location, or printed on adjacent locations, of print medium 40 in order to form a range of composite colors.

Image data may be organized as rows and columns of image pixels 121 having a predetermined number of pixels per inch, such as 300 or 600 pixels per inch, in each direction. For example, image data fragment 120 illustrates three rows and five columns of circular pixels having center-to-center spacing 122 of $1/300^{th}$ inch in both the row and column directions, indicating a pixel data resolution of 300 pixels per inch. The pixel resolution is not required to be the same for rows as for columns; in other words, pixels are not required to be circular. In addition, the number of pixels per inch may, but is not required to, match the number of print elements per inch.

During a printing operation, printhead arrangement 15 may be positioned by print element position control mechanism 118 at a known, fixed location along slider bar 110 relative to print medium rows (or columns, depending on orientation), such as row 116, on print medium 40, and maintained in that location during the printing operation. In this known, fixed location, a particular print element may be correlated to, or associated with, a particular print medium row. For example, it could be determined by printer 10 from the location of printhead arrangement 15 along slider bar 110, and the geometries of the printheads 20 such as the density of print elements per inch, that print elements 30*a-d* will emit ink onto row 116.

Similarly, when printhead arrangement 15 is positioned at a known, fixed location along slider bar 110, image data 120 may be processed using the pixel data resolution to determine the particular rows (or columns, depending on orientation) of pixel data that are associated with particular print elements. For example, it could be determined that the pixels of row 123 are to be printed by ink emitted from print elements 30*a-d*.

An image pipeline 50 receives image data 120 and processes it for printing. In some embodiments, the image pipeline 50 may convert the image data from one color format to another, compensate for defective print elements to minimize adverse effects on print quality, generate print data compatible with the printheads 20, and orchestrate the controllable emission of ink drops from the printheads 20 to form the desired color image corresponding to image data 120. The image pipeline 50 will be considered subsequently in greater detail with reference to FIGS. 9-12.

A print element quality detector 130 identifies defective print elements in a printhead. In one embodiment, printhead arrangement 15, print element quality detector 130, or both can be moved such that one or more printheads 20, or portions thereof, are adjacent each other. An optical detector typically include a light sensor such as a photo diode which senses the light provided by a light source such as an LED. When an ink drop is present in the light path between the light sensor and the light source, the output of the light sensor changes since the amount of light sensed by the light sensor is reduced by the presence of the ink drop. The output of the light sensor may be amplified and analyzed to determine whether an ink drop passed through the light path between the light source and the light sensor. In another embodiment, an optical reflective detector can be positioned adjacent the print medium 40 to optically determine the presence of an ink drop on the medium 40. In other embodiments of the print element quality detector 130 an acoustical drop detector or an electrostatic in-flight sensor can be used. Additional details on the construction and operation of such sensors, and on methods for the detection and identification of defective and functional printing elements, may be found in U.S. Pat. No. 6,278,469 granted to Bland et al.

A pixel data to print element mapper 140 maps the defective print elements in a printhead to the corresponding rows (or columns) of pixels of the image data 120. This serves to identify the image pixels that need to be compensated for in order to minimize the adverse effect of the defective print elements on print quality. Compensation for these image pixels will be discussed subsequently with reference to FIG. 9. In some embodiments, the mapper 140 may be implemented as instructions stored in memory 124 that are executed by processor 122. In other embodiments, the mapper 140 may be implemented in hardware such as a state machine or ASIC, or within image pipeline 50.

It should be noted that while FIG. 1 illustrates by way of example an embodiment of the present invention utilizing four printheads 20 for KCMY color inks, other embodiments of the invention may use fewer or more printheads, and different color inks. For example, another embodiment includes six printheads, and adds light cyan (c) and light magenta (m) inks to form a KCcMyY printing system. Another embodiment of a six printhead system uses violet (V) and orange (O) inks to perform KCMYVO printing system. Yet a further embodiment of three printheads forms a CMY printing system.

It should further be noted that while the present invention will typically be described with reference to single pass printing, it can also be used in non-indexed multiple pass printing in which the print elements are positioned adjacent a given region of the print medium more than once during printing such that each print element prints a same portion of the image data during each of the multiple passes. In other words, there is no movement of the printhead arrangement 15 to a different position along slider bar 110 between passes.

As best understood with reference to FIGS. 3-6, one embodiment of the invention is a method 300 (FIG. 3) for printing an image with at least one linear array of print elements. At 302, defective ones of the print elements associated with a particular colored fluid, such as a colored ink, are detected. The positions in the linear array of the defective print elements are identified, and in some cases groups of adjacent defective print elements occur. This detection and identification may be performed as has been described heretofore with reference to FIG. 1. At 304, the image data to be printed is received, such as from a computer connected to the printer 10. At 306, the defective print elements are associated with, or mapped to, corresponding pixel rows of the image data. The association or mapping may also be performed as has been described heretofore with reference to FIG. 1. A first defective print element compensation operation is performed at 308 for portions of the image data that are associated with a first predetermined number or fewer adjacent ones of the defective print elements, while a different second defective print element compensation operation is performed at 310 for portions of the image data that are associated with a second predetermined number or more adjacent defective print elements. The compensation operations minimize the adverse effect on print quality of the defective print elements without reducing the throughput or print speed. In some embodiments the compensation operations, as will be discussed subsequently with reference to FIGS. 10-12, may be performed at various stages of the image pipeline 50. In other embodiments, the compensation operations may be performed by processor 122 (FIG. 1) as instructed by software or firmware code residing in memory 124, or by another state machine or ASIC (not shown). In still other embodiments, processor 122, as instructed by software or firmware code residing in memory 124, may appropriately configure the image pipeline 50 to perform the compensation operations.

Figure 4:
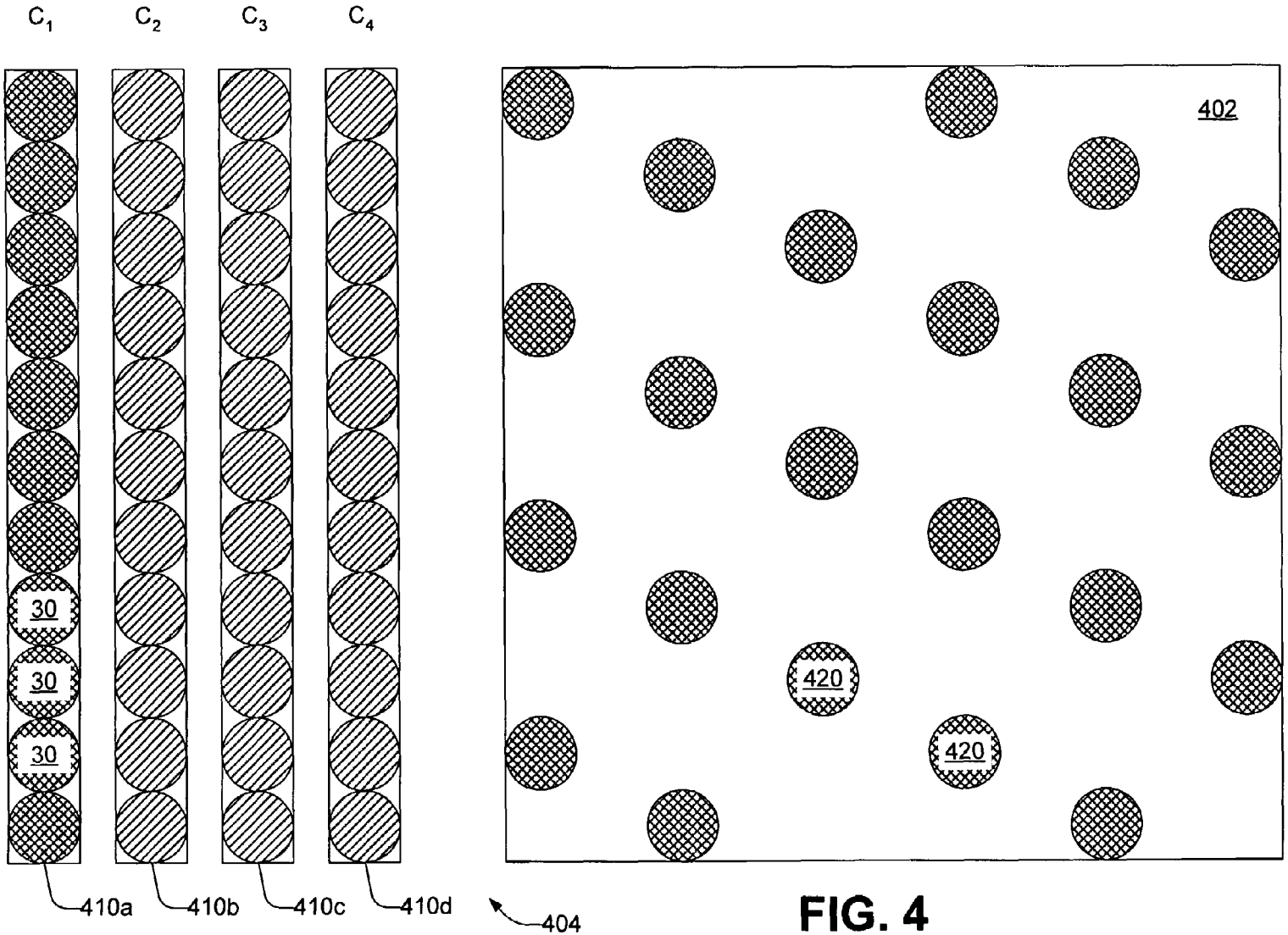
FIG. 4 is an enlarged schematic representation of a portion of a multiple-printhead printing arrangement and exemplary printed output where all print elements of all printheads are non-defective.

The exemplary printed portion 402 of print medium 40 in FIG. 4 represents a greatly enlarged region of the medium 40. The exemplary printhead arrangement 404 includes four print element arrays 410*a-d* each having eleven print elements 30. Arrays 410*a-d* emit ink drops of colors $C_1$, $C_2$, $C_3$, and $C_4$ respectively. After processing of the image data 120 through image pipeline 50, it is determined that the portion 402 is to be printed in a sparse pattern of uniform color that is formed by controllably depositing drops of ink of only color $C_1$ from the print elements 30 of array 410*a* onto locations, such as locations 420, that are indicated by cross-hatching. Medium position control mechanism 106 (FIG. 1) moves the medium 40 relative to the printhead arrangement 404 and the drops are deposited accordingly. None of the print elements 30 of array 410*a* are defective.

Figure 5:
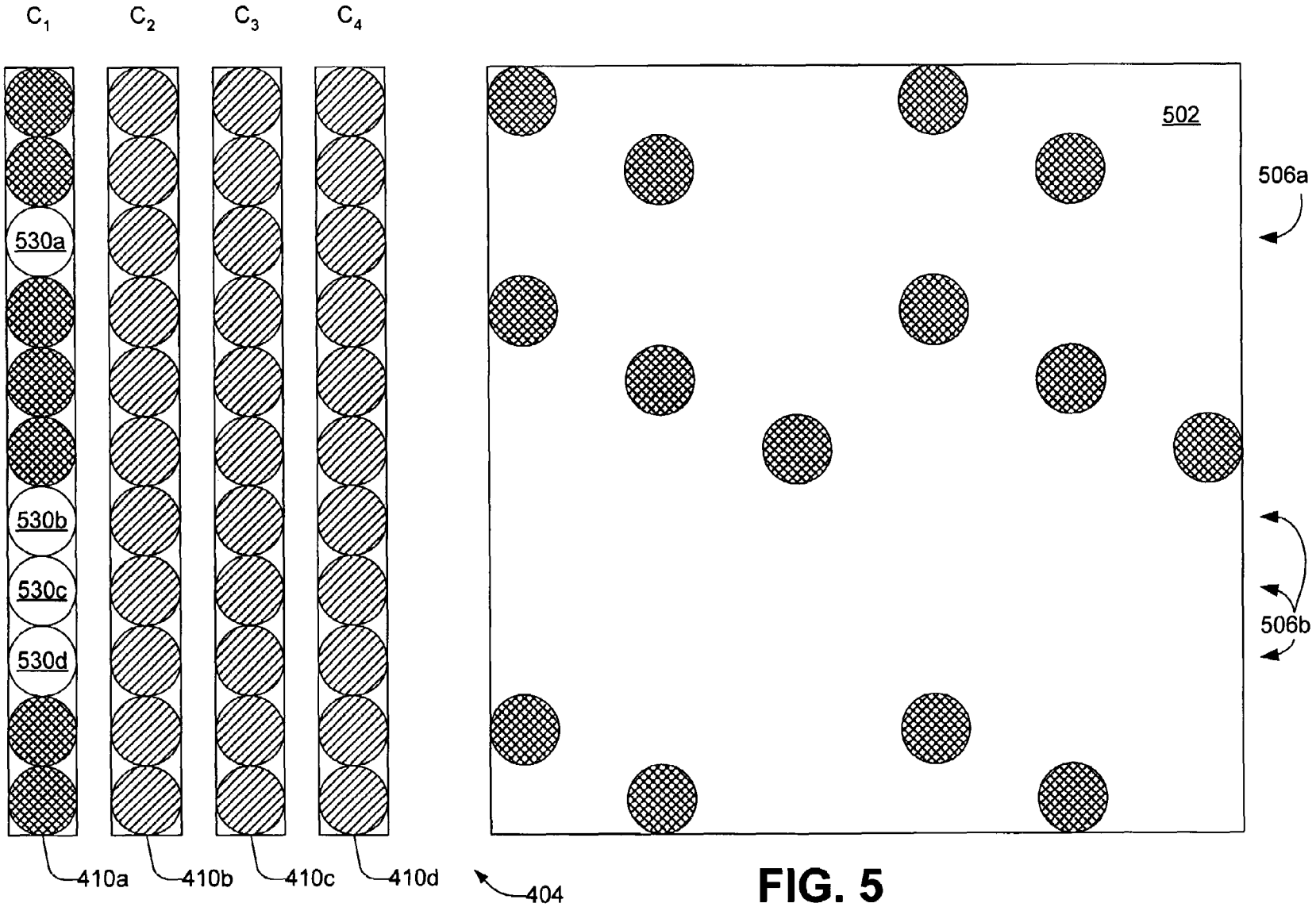
FIG. 5 is an enlarged schematic representation of a portion of a multiple-printhead printing arrangement and exemplary printed output where some print elements of a printhead are defective resulting in undesirably degraded print quality.

The adverse effect of defective print elements 530*a-d* on image quality can be understood with reference to FIG. 5. No ink is deposited from defective print elements 530*a-d* (as illustrated by the lack of cross-hatching on elements 530*a-d*) on the exemplary printed portion 502 of print medium 40. As a result, horizontal lines or streaks 506*a-b* of color non-uniformity that correspond to the defective print elements 530*a-d* are visible in printed portion 502. In addition, the print density (the number of ink drops in portion 502) is lower than required.

Figure 6:
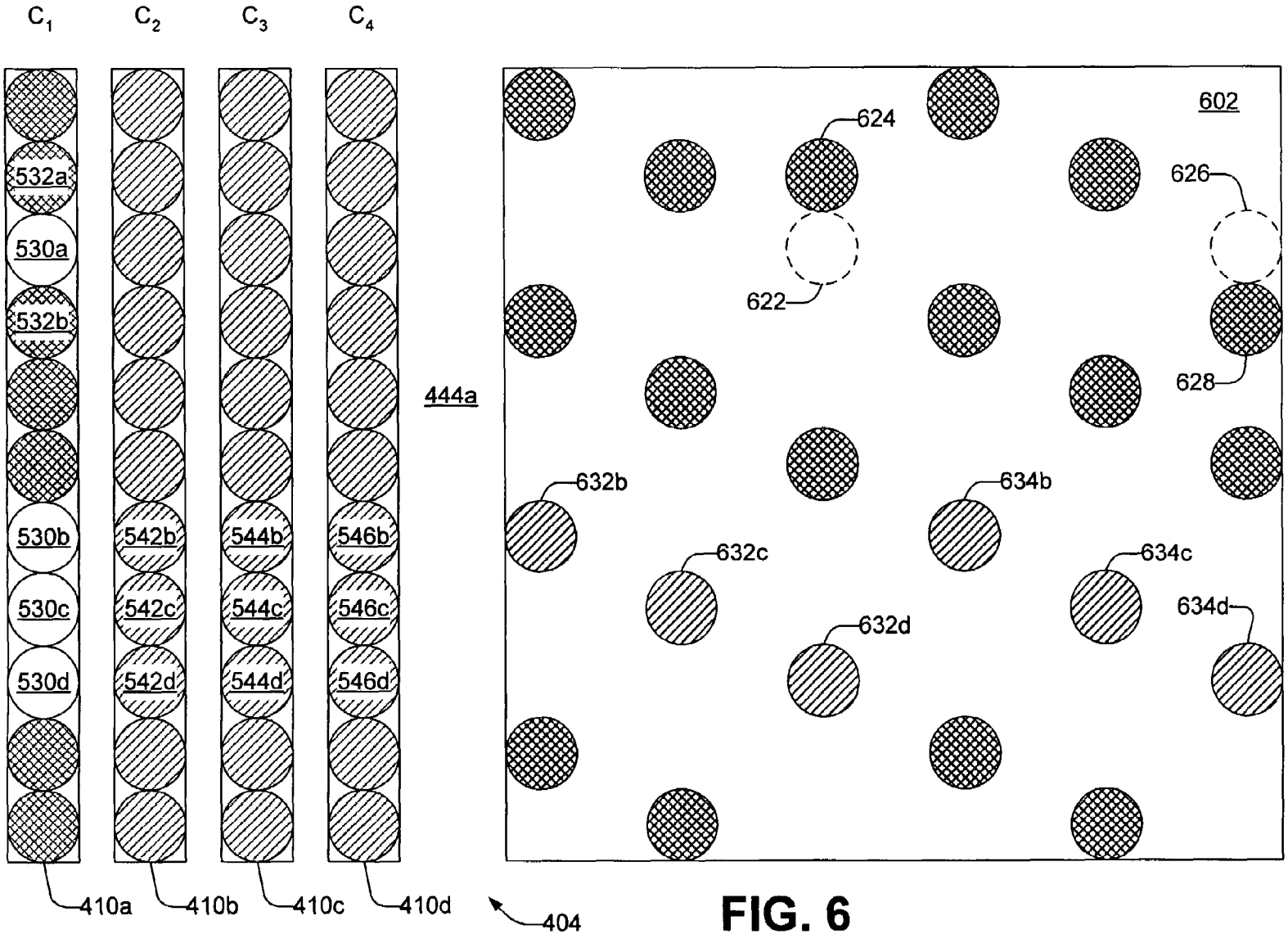
FIG. 6 is an enlarged schematic representation of a portion of a multiple-printhead printing arrangement and exemplary printed output where some print elements of a printhead are defective but where the undesirable effects on print quality have been mitigated, according to an embodiment of the present invention.

The advantageous effect of the compensation operations utilized in embodiments of the present invention can be understood with reference to FIG. 6. A first compensation operation is performed for relatively smaller numbers of adjacent print nozzles. In one embodiment, the first compensation operation is performed for groups of two or fewer adjacent defective print elements. In one embodiment, the first compensation operation includes ejecting an increased amount of the particular colored fluid from functional (i.e. non-defective) print elements adjacent the defective print elements. For example, non-defective print elements 532*a-b* are adjacent defective print element 530*a* in array 410. To compensate for defective print element 530*a*, the drop of color $C_1$ ink that would have ideally been deposited on location 622 is deposited instead on adjacent location 624 by non-defective print element 532*a*, and the drop of color $C_1$ ink that would have ideally been deposited on location 626 is deposed instead on adjacent location 628 by non-defective print element 532*b*. As a result, the desired print density is maintained, and the visibility of any streaking is minimal since it corresponds to the width of only a single print element.

A second, different compensation operation is performed for relatively larger numbers of adjacent print nozzles. As the number of adjacent defective print elements increases, it becomes more difficult to reduce the visibility of streaking with ink from adjacent print elements because of the increased width of the streaks. In one embodiment, the second compensation operation is performed for groups of three or more adjacent defective print elements. In one embodiment, a predetermined amount of at least one different colored fluid is ejected from print elements coincident with the defective print elements. For example, print elements 542*b* (for color $C_2$ ink), 544*b* (for color $C_3$ ink), and 546*b* (for color $C_4$ ink) are all coincident with defective print element 530*b* in that they can emit ink drops onto the same row 604 of locations of printed portion 602 as can defective print element 530*b*. Similarly, print elements 542*c*,544*c*,546*c* are all coincident with defective print element 530*c*, and print elements 542*d*,544*d*,546*d* are all coincident with defective print element 530*d*. To compensate for defective print element 530*b*, a predetermined amount of ink can be ejected from one or more of print elements 542*b*,544*b*,546*b* onto locations 632*b*, 634*b*. In some embodiments, the predetermined amounts of colors $C_2$, $C_3$, and $C_4$ ink are selected so as to produce print output at locations 632*b*,634*b* that is substantially equivalent in color to print output that would have been produced by $C_1$ color ink at those locations. For example, if the color of C1 through C4 inks are black (K), cyan (C), magenta (M), and yellow (Y) respectively, then predetermined amounts of CMY ink from print elements 542*b-d*, 544*b-d*, and 546*b-d* respectively can produce composite black print output that is substantially equivalent in color to the true black print output that would have been produced from defective print elements 530*b-d*. To compensate for defective print element 530*c*, a predetermined amount of ink can be similarly ejected from one or more of print elements 542*c*,544*c*,546*c* onto locations 632*c*,634*c*, and to compensate for defective print element 530*d*, a predetermined amount of ink can be ejected from one or more of print elements 542*d*,544*d*,546*d* onto locations 632*d*,634*d*.

In other embodiments, the predetermined amounts of colors $C_2$, $C_3$, and $C_4$ ink are selected so as to produce print output at locations 632,634 that is substantially equivalent in lightness to print output that would have been produced by $C_1$ color ink at those locations. For example, if the color of C1 through C4 inks are cyan (C), magenta (M), yellow (Y), and black (K) respectively, then in one embodiment a predetermined amount of the K ink from print elements 546*b-d* can produce black (or gray) print output that is substantially equivalent in lightness to the cyan print output that would have been produced from defective print elements 530*b-d*. In another embodiment, a predetermined amount of the M ink from print elements 542*b-d* can produce magenta print output that is substantially equivalent in lightness to the cyan print output that would have been produced from defective print elements 530*b-d*. K ink may produce print output that is closer in color to the desired cyan print output than does M ink. Similarly, if the color of C1 through C4 inks are magenta (M), cyan (C), yellow (Y), and black (K) respectively, then in one embodiment a predetermined amount of the K ink from print elements 546*b-d* can produce black (or gray) print output that is substantially equivalent in lightness to the magenta print output that would have been produced from defective print elements 530*b-d*. In another embodiment, a predetermined amount of the C ink from print elements 542*b-d* can produce cyan print output that is substantially equivalent in lightness to the magenta print output that would have been produced from defective print elements 530*b-d*. K ink may produce print output that is closer in color to the desired magenta print output than does C ink.

Equivalent color and equivalent lightness refer to visual properties of the print output. In one system of color representation, the attributes of hue, chroma, and lightness define color. Hue describes the basic color perception of an object in which it is judged to be red, yellow, green purple, orange, blue-green, and so forth. Chroma describes the intensity or saturation of the object; in other words, how grayish it appears for a given level of lightness; the more grayish, the less saturated. Lightness describes how light or dark an object is for its given chroma. Equivalent lightness refers only to equivalence of this latter attribute, whereas substantially equivalent color refers to equivalence of all three of the attributes of hue, chroma, and lightness. For further details on color measurement and its relation to human color perception see, Hunt, R. W. G., The Reproduction of Colour, Fifth Edition, Foundation Press, 1995; Hunt, R. W. G., Measuring Colour, Third Edition, Foundation Press, 1998; and Billmeyer, Fred W., Jr., and Max Saltzmann, Principles of Color Technology, John Wiley & Sons, 1981.

Figure 7:
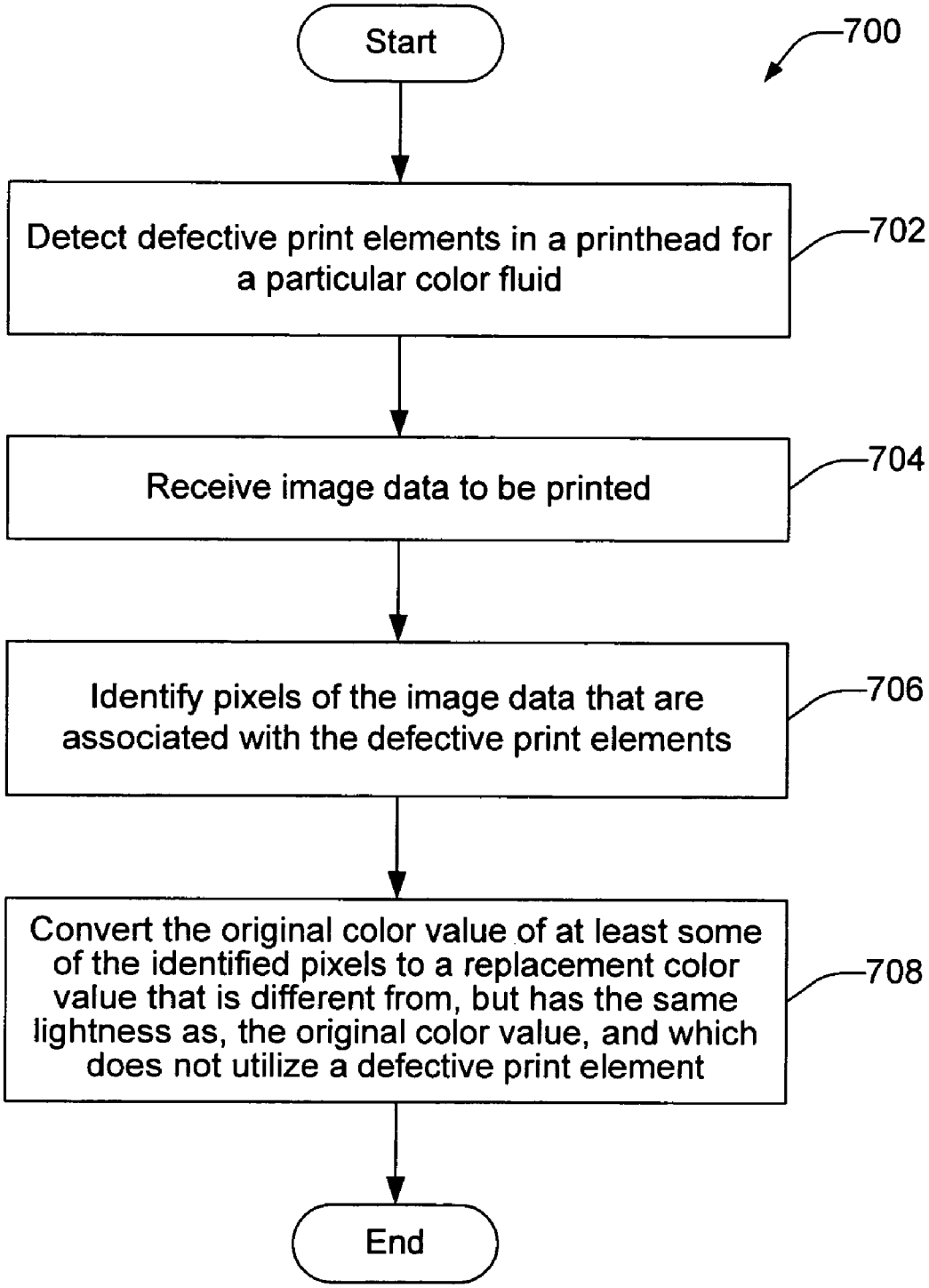
FIG. 7 is a flowchart of another embodiment of a printing method in accordance with the present invention.

Another embodiment of the present invention, as best understood with reference to FIG. 7, is a method 700 for printing an image where the image includes image data pixels that each have an original color value. At 702, defective print elements in a printhead for a particular color fluid are detected. This detection may be performed as has been described heretofore with reference to FIG. 1. At 704, the image data to be printed is received, such as from a computer connected to the printer 10. At 706, pixels of the image data that are associated with the defective print elements are identified. The association and identification may be performed as has been described heretofore with reference to FIG. 1. At 708, the original color value of at least some of the identified pixels is converted to a replacement color value that is different from the original color value and which, when printed, does not utilize the corresponding defective print element. In some embodiments, the replacement color value has substantially the same lightness as the original color value. In other embodiments, the replacement color value has substantially the same color as the original color value. The original color value and the replacement color value are each expressed in a color data format.

Figure 8:
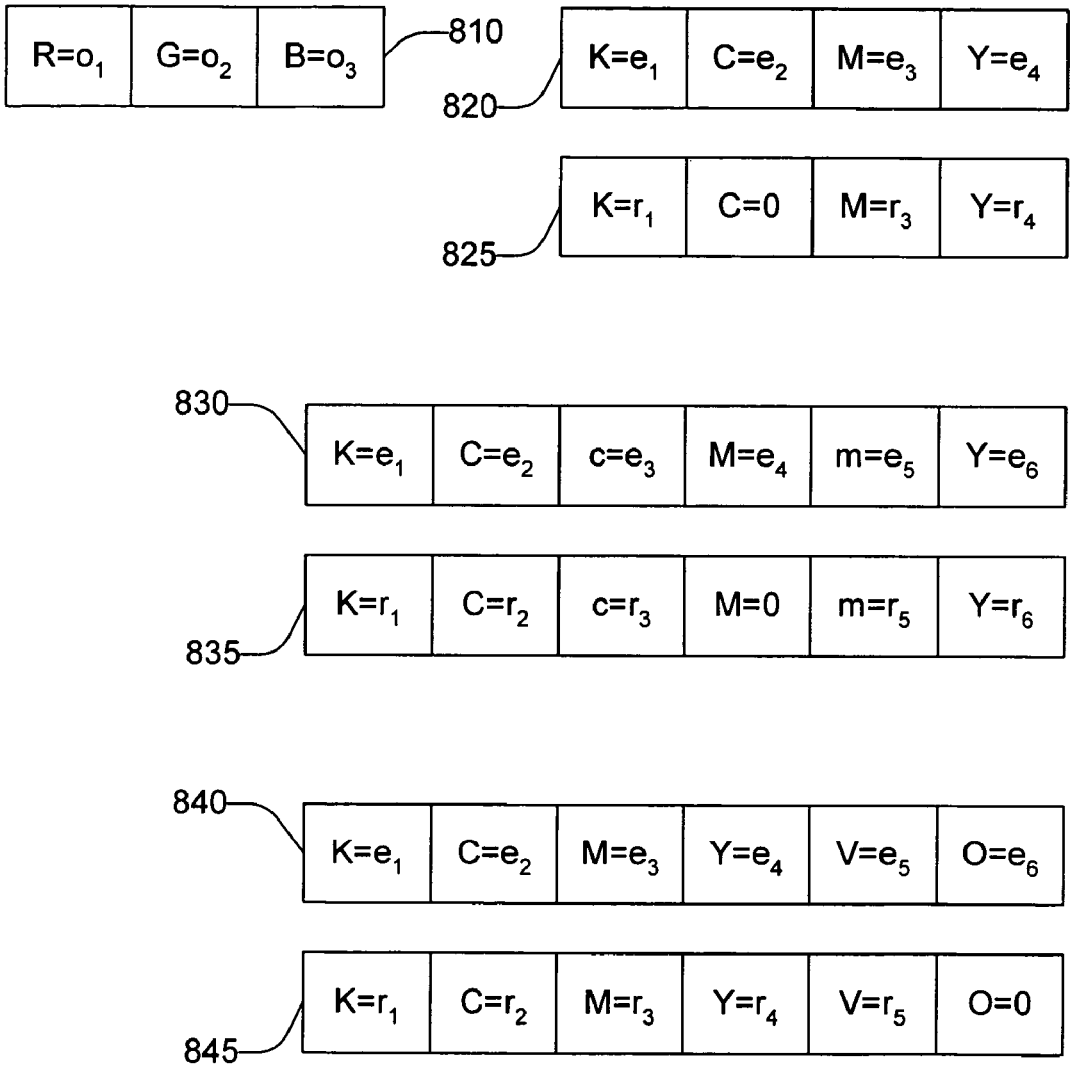
FIG. 8 is a schematic representation of pixel image data formats according to an embodiment of the present invention.

Considering now in greater detail the color data format, and with reference to FIG. 8, the format of the replacement color value may be the same as, or different from, the format of the original color value. For example, in some embodiments the original color value may be expressed in an RGB color space format. An RGB color space uses as its primary colors red, green, and blue. These three colors are the primary "additive" colors. In devices that use projected light to produce an image (for example, televisions, computer displays, or digital projectors), the complete spectrum of colors can be reproduced using red, green, and blue. All three primary additive colors combine to form white. Any other color can be produced by combining different amounts of the three primary colors. An RGB color value 810 includes numeric values representative of each of the color components R, G, and B. In some embodiments, the colors of the original color format do not correspond to the colors of the color fluids; for example, the R, G, and B color components would not correspond to a printer having cyan, magenta, yellow, and black inks.

There is typically a one-to-one mapping between color values in the original color data format and the replacement color data format. In some embodiments, the replacement color value may be expressed in a color space format that corresponds to the colors of the fluids or inks used in the printer. For example, for a printer having cyan, magenta, yellow, and black inks, the replacement color value may be expressed in a CMYK color space format. CMY represent the primary colors cyan, magenta and yellow. These three colors are the primary "subtractive" colors, because when printed on media such as paper, the CMY colors subtract some colors while reflecting others. In theory, all three primary subtractive colors combine to form black. However, it is sometimes difficult to get a visual pleasing black color when printing with only CMY color fluids, so many subtractive color-based printing systems add a black color fluid, K, to enhance darker or black color regions of the printed output. Accordingly, the replacement color value may be expressed in a KCMY color space format. A KCMY color value 820 includes numeric values representative of each of the color components C, M, Y, and K.

In other embodiments, alternative color data formats, such as KCcMyY and KCMYVO, may be used. Such alternative formats are typically used for replacement color value data 830,840 where the corresponding colors are the base colors of the fluids or inks used in the printer.

Another characteristic of color data formats is the tone of the color data value. Tone refers to the granularity or resolution of the data value of each color component. For example, color data values each represented by a relatively larger number of data bits, such as at least eight bits of data (i.e. 256 different possible values) for each of the color components R, G, and B, may be referred to as continuous-tone data. In such a format, a total of 24 bits of data are used to represent a particular RGB continuous-tone color value, and thus a wide range of color values can be expressed.

Color data values may also be expressed in a halftoned data format. In such a format, color data values may each be represented by a relatively smaller number of data bits, such as one or two bits of data. With a small number of data bits, color data values represent discrete tones, rather than continuous ones. Two bits of data provide up to four discrete color values, while one bit of data provides two discrete color values. In some embodiments, color data values are eventually converted to halftoned data, where each discrete halftoned data value corresponds to a particular number of fluid drops of the corresponding color.

Each of the original color data format and the replacement color data format can be either continuous tone or halftoned. In some embodiments, the original color data format and the replacement color format have the same tone, while in other embodiments they have different tones. In one embodiment, both the original color data format and the replacement color data format are continuous tone.

Figure 9:
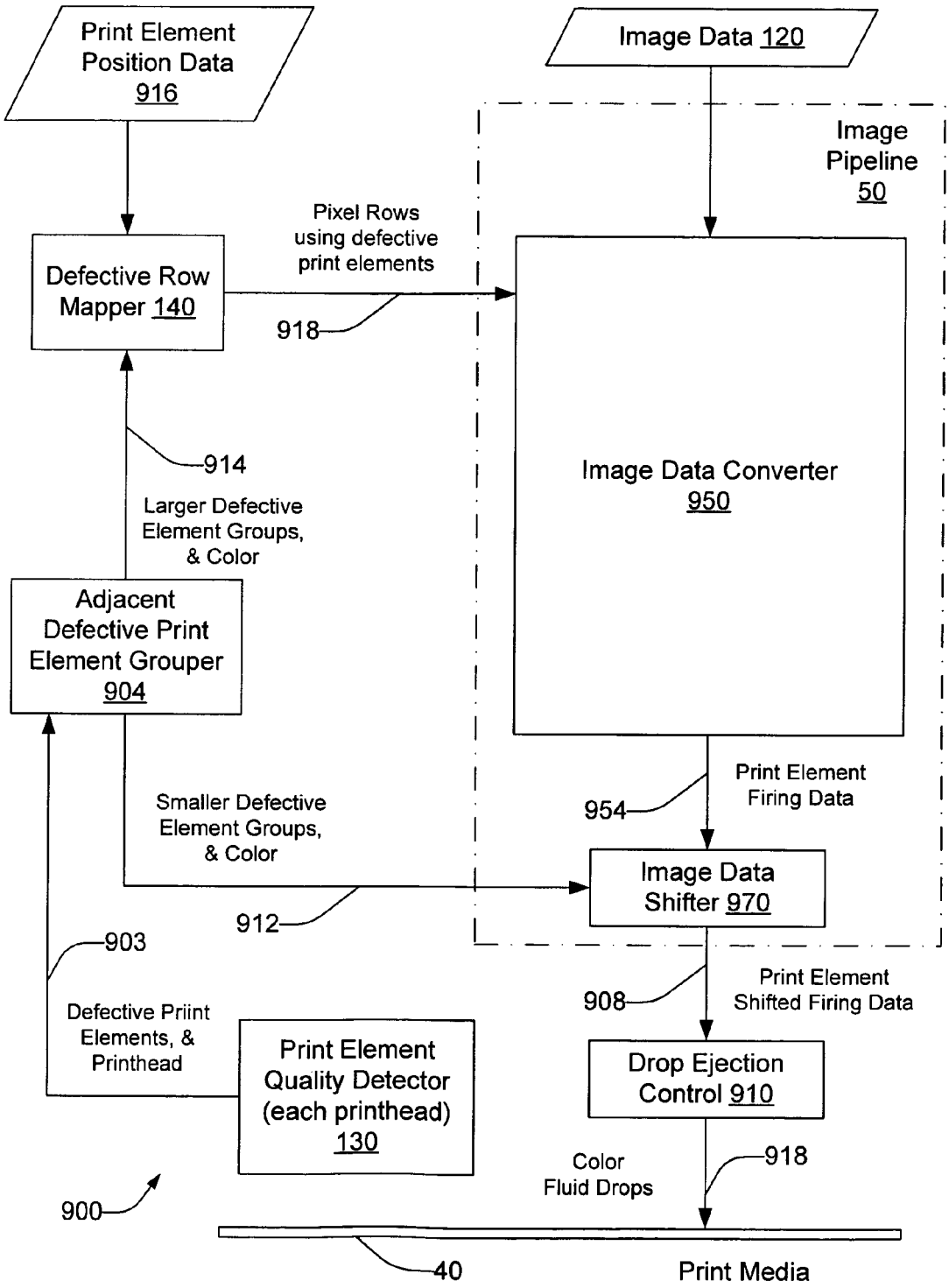
FIG. 9 is a schematic representation of a printing system in accordance with another embodiment of the present invention.

Another embodiment of the present invention, as best understood with reference to FIG. 9, is a printing system 900 for printing color image data. Printing system 900 includes, as has been explained heretofore with reference to FIG. 1, an array of print elements, such as disposed in printhead 20, is positionable at a fixed location relative to rows, such as row 116, of a print medium 40 during a printing pass. Printing system 900 also includes print element quality detector 130 that is configured to identify defective print elements. Identification 903 of the defective print elements detected by detector 130, and the printheads 20 with which they are associated, are provided to defective element grouper 904. Grouper 904 identifies groups of adjacent defective elements in a given printhead associated with a corresponding color ink. For relatively smaller groups of adjacent defective elements in a printhead, identification 912 of the relatively smaller groups and ink color is provided to image pipeline 50. For relatively larger groups of adjacent defective elements in a printhead, identification 914 of the relatively larger groups and ink color is provided to defective row mapper 140, which maps the defective print elements to corresponding rows of pixels of the image data 120 based on print element position data 916, as has been described heretofore with reference to FIG. 1. Mapper 140, in turn, provides identification 918 of the pixel rows that are using defective print elements of a particular color to image pipeline 50

In some embodiments, grouper 904 may be implemented as instructions stored in memory 124 that are executed by processor 122. In other embodiments, the mapper 140 may be implemented in hardware such as a state machine or ASIC, or within image pipeline 50.

The image pipeline 50 receives image data 120 and, using the identification 918 of the pixel rows for the relatively larger groups of defective print elements (provided by the mapper 140) and the identification 912 of the relatively smaller groups of defective print elements and ink color (provided by the grouper 904), produces print element shifted firing data 908. The firing data 908 is provided to drop ejection controller 910. The operation of controller 910 is coordinated with the operation of media position control mechanism 106 and print element position control mechanism 118 so as to deposit the proper color fluid drops 918 on the print medium 40 in order to print the image represented by image data 120.

In one embodiment, image pipeline 50 includes an image data converter 950 and an image data shifter 970. The image data converter 950 receives identification 918 of, and compensates for, the relatively larger groups of defective print elements of a particular color printhead 20 by, in one embodiment, producing print element firing data 954 which requires ejection of fluid of a different color from print elements in a different printhead 20 that are coincident with the defective print elements. The image data shifter 970 receives identification 912 of, and compensates for, the relatively smaller groups of defective print elements of a particular color printhead 20 by, in one embodiment, producing shifted print element firing data 908 which requires ejection of an increased amount of the same color fluid from print elements in the same printhead 20 that are adjacent to the defective print elements. In one embodiment, the relatively larger groups include three or more adjacent defective print elements, while the relatively smaller groups include two or fewer adjacent defective print elements. U.S. Pat. No. 6,722,751 to Barr et al., assigned to the assignee of the present invention, provides additional description of image data shifting.

As part of providing the print element firing data 954, image data converter 950 typically converts the color values of the individual pixels of the image data 120 in their original color data format to color values in another color data format that is appropriate for printing with printheads 20. In some embodiments image data converter 956 includes a color converter configured to convert via a standard color map an original color value of individual pixels of the image data in a first color format to a substantially equivalent color value in a second color format. The color converter is further configured to convert via a replacement color map the original color value of the individual pixels of the image data in the first color format to a replacement color value in a second color format, the replacement color value having substantially the same lightness as the original color value and not requiring use of any of the defective print elements.

The image pipeline 50, in some embodiments, is implemented in hardware rather than firmware or software. The hardware may include one or more application-specific integrated circuits (ASICs), logic elements, state machines, digital signal processors, or other electronic circuitry configured to function as described herein. Some embodiments of the image pipeline 50 may be particularly suited to hardware implementations due to the iterative nature of its image data pixel processing operations, the desirability of processing the image data at hardware speeds so as to improve print speed, and the ability to allow the various stages or elements of the image pipeline 50 to operate concurrently. In some embodiments, operation of the image pipeline 50 may be configured by software instructions in memory 124 executed by processor 122 (FIG. 1).

Figure 10:
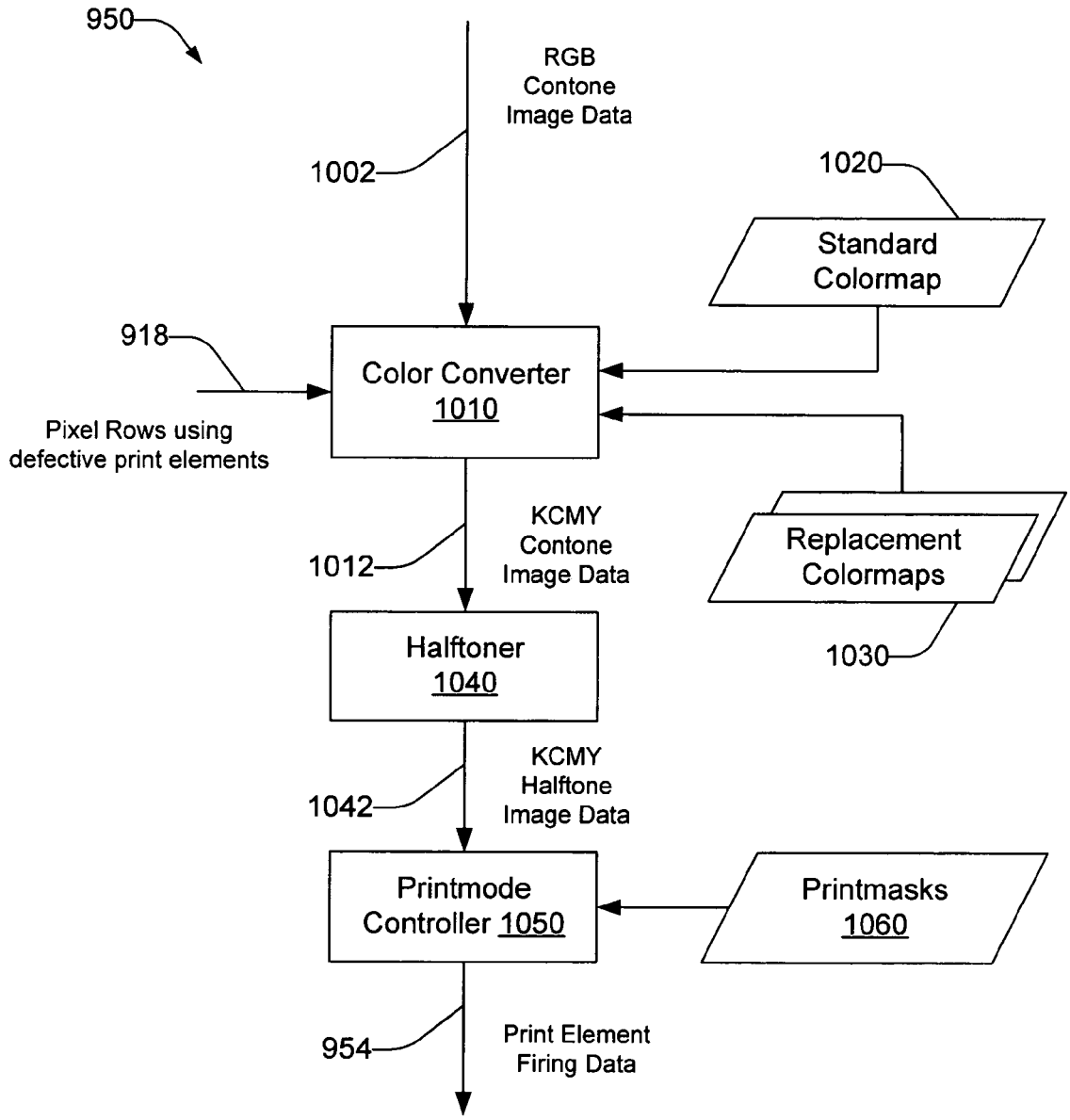
FIG. 10 is a schematic representation of an image data converter usable with the printing system of FIG. 9 in accordance with an embodiment of the present invention.

Considering now in greater detail one embodiment of image data converter 950, and with reference to FIG. 10, color converter 1010 receives image data 120 that includes RGB continuous tone image data 1002. Each image pixel has an original color value 810 (FIG. 8) that is expressed in an RGB continuous tone data format. Color converter 1010 is configured to generate a corresponding converted color value in a KCMY continuous tone data format 820 for each image pixel, thus generating KCMY continuous tone data 1012. The conversion of color values utilizes a colormap, such as standard colormap 1020 or one of a set of replacement colormaps 1030.

In one embodiment, the colormap is a lookup table (LUT). Where the RGB and KCMY data has 8 bits per color component, a 17×17×17 colormap may be used. Such an LUT saves considerable data storage space compared to a 256×256×256 LUT that provides direct lookup of the output KCMY color value for any possible input RGB color value. When a 17×17×17 colormap is used, the table entry or entries nearest to the RGB color value are identified, and a calculation, such as interpolation, is performed in order to identify the appropriate KCMY color value.

In the standard colormap 1020, the table entries are predetermined in advance, typically during the design of the printing system 900, to produce KCMY continuous tone output data 1012 from the color converter 1010 that is as close as possible in both lightness and color to the RGB continuous tone input data 1002. For example, an original 8-bit continuous tone color value 810 of RGB=$o_1,o_2,o_3$ produces an equivalent 8-bit continuous tone color value 820 of KCMY=$e_1,e_2,e_3,e_4$, where $o_N$ and $e_N$ may each have a value between 0 and 255, that is substantially equivalent in both lightness and color. In addition, entries in the standard colormap 1020 are chosen to optimize color gamut, uniformity in color and grain, ink usage, and drying time for the printed output.

Each replacement colormap 1030 is associated with a particular color ink. The particular color ink is the color associated with defective printing elements, and thus the color that is unavailable for printing the image data associated with those defective printing elements. Therefore, the set of replacement colormaps includes a replacement colormap 1030 for each color of ink or fluid included in the printing system 900; for example, where the printing system 900 includes KCMY inks, there are four replacement colormaps 1030, one each for K, C, M, and Y as the unavailable ink color. The table entries in each replacement colormap 1030 are predetermined in advance, typically during the design of the printing system 900, to produce KCMY continuous tone output data 1012 from the color converter 1010 that is as close as possible, at least in lightness, to the RGB continuous tone input data 1002 without using the unavailable ink color. For example, assuming that the unavailable ink color is cyan (C), then an original 8-bit continuous tone color value 810 of RGB=$o_1,o_2,o_3$ produces a replacement 8-bit continuous tone color value 825 of KCMY=$r_1,0,r_3,r_4$, where $o_N$ and $r_N$ may each have a value between 0 and 255, that is substantially equivalent in lightness but not necessarily in color. Because cyan is the unavailable color, all entries in the replacement colormap 1030 for cyan set the output level C=0. For some table entries, the level of black data, magenta data, or both may be boosted, versus the standard colormap 1020, in order to replace the missing cyan. In practice, rows of print output that are substantially equivalent in lightness, even though not in color, minimize the adverse impact on print quality of defective print elements, even when used with larger groups of up to about eight adjacent defective print elements. However, table entries in the replacement colormap 1030 are also chosen to minimize as far as possible the difference in color; for example, replacement of missing cyan ink with boosted black data may produce a smaller color difference than replacement with boosted magenta data.

Some replacement colormaps 1030 can substantially equalize color in addition to lightness. For example, where the unavailable ink is black (K) ink, some table entries may boost the levels of cyan, magenta, and yellow data, versus the standard colormap 1020, which will produce a composite black color to replace the missing true black K ink. In practice, this can minimize the adverse impact on print quality of defective print elements when used with larger groups of up to about twenty adjacent defective black print elements.

Other replacement colormaps 1030 may, for example, boost cyan data to replace missing magenta ink. In other printing systems such as those containing KCcMmY or KCMYVO inks in which RGB continuous tone data is color-converted to KCcMmY or KCMYVO continuous tone data respectively, other combinations of replacement colors may be chosen in order to produce substantially equivalent lightness and, if possible, color so as to minimize degradation in print quality due to the defective print elements. For example, missing magenta (M) ink may be replaced by boosted light magenta (m) data in such a manner so as to produce substantially equivalent color as well as lightness. Accordingly, an original 8-bit continuous tone color value 810 of RGB=$o_1$,$o_2$,$o_3$ may, instead of producing an 8-bit continuous tone color value 830 of KCcMmY=$e_1$,$e_2$,$e_3$,$e_4$,$e_5$,$e_6$ that potentially uses all of the color inks, produce a replacement 8-bit continuous tone color value 835 of KCcMmY=$r_1$,$r_2$,$r_3$,0,$r_5$,$r_6$ that is substantially equivalent in color as well as lightness. Because magenta (M) is the unavailable color, all entries in the replacement colormap 1030 for magenta set the output level M=0.

In another exemplary printing system, missing violet (V) ink may be replaced by a combination of magenta (M) and cyan (C) inks, or missing orange (O) ink may be replaced by a combination of magenta (M) and yellow (Y) inks, in such a manner so as to produce substantially equivalent color as well as lightness. Accordingly, an original 8-bit continuous tone color value 810 of RGB=$o_1$,$o_2$,$o_3$ may, instead of producing an 8-bit continuous tone color value 840 of KCMYVO=$e_1$,$e_2$,$e_3$,$e_4$,$e_5$,$e_6$ that potentially uses all of the color inks, produce a replacement 8-bit continuous tone color value 845 of KCMYVO=$r_1$,$r_2$,$r_3$,$r_4$,$r_5$,0 that is substantially equivalent in color as well as lightness. Because orange (O) is the unavailable color, all entries in the replacement colormap 1030 for orange set the output level O=0.

In order to determine the pixel data for which the replacement colormap 1030 should be used by the color converter 1010 instead of the standard colormap 1020, the color converter 1010 also receives the identification 918 of the pixel rows that are associated with defective print elements of a particular printhead 20, and thus a particular color ink associated with that particular printhead. In some embodiments, the image data pixels are processed by rows, and when the color converter 1010 detects that pixels of a row associated with a defective print element of a particular printhead 20 are to be processed, the particular color ink that is unavailable is identified, and the replacement colormap 1030 for that color is used by the color converter 1010 instead of the standard colormap 1020. Typically, all of the image pixels of the row are converted using the replacement color map 1030 instead of the standard colormap 1020.

After the color conversion of the RGB continuous tone data 1002 to the KCMY continuous tone data 1012, a halftoner 1040 converts the KCMY continuous tone data 1012 to KCMY halftone data 1042. In some embodiments, the discrete levels of the halftone data 1042 are indicative of the number of drops of the corresponding color ink that are to be emitted from the print elements associated with each pixel of the halftone 1042.

In some embodiments, such as in a multi-pass non-indexed printmode, a printmode controller 1050 temporally separates some portions of the KCMY halftone data 1042 from other portions of the KCMY halftone data 1042 so that they are printed on a particular printing pass. In general, the percentage of the data printed on each pass is the reciprocal of the number of passes; for example, in a two pass non-indexed printmode, one-half (or 50%) of the data will be printed in each pass. The locations which will be printed in a particular pass are governed by printmasks 1060, which may form a checkerboard or other distributed pattern that helps "mix up" the print elements used on each pass in such a way as to reduce undesirable visible printing artifacts and ensure a uniform appearance for the printed output.

Figure 11:
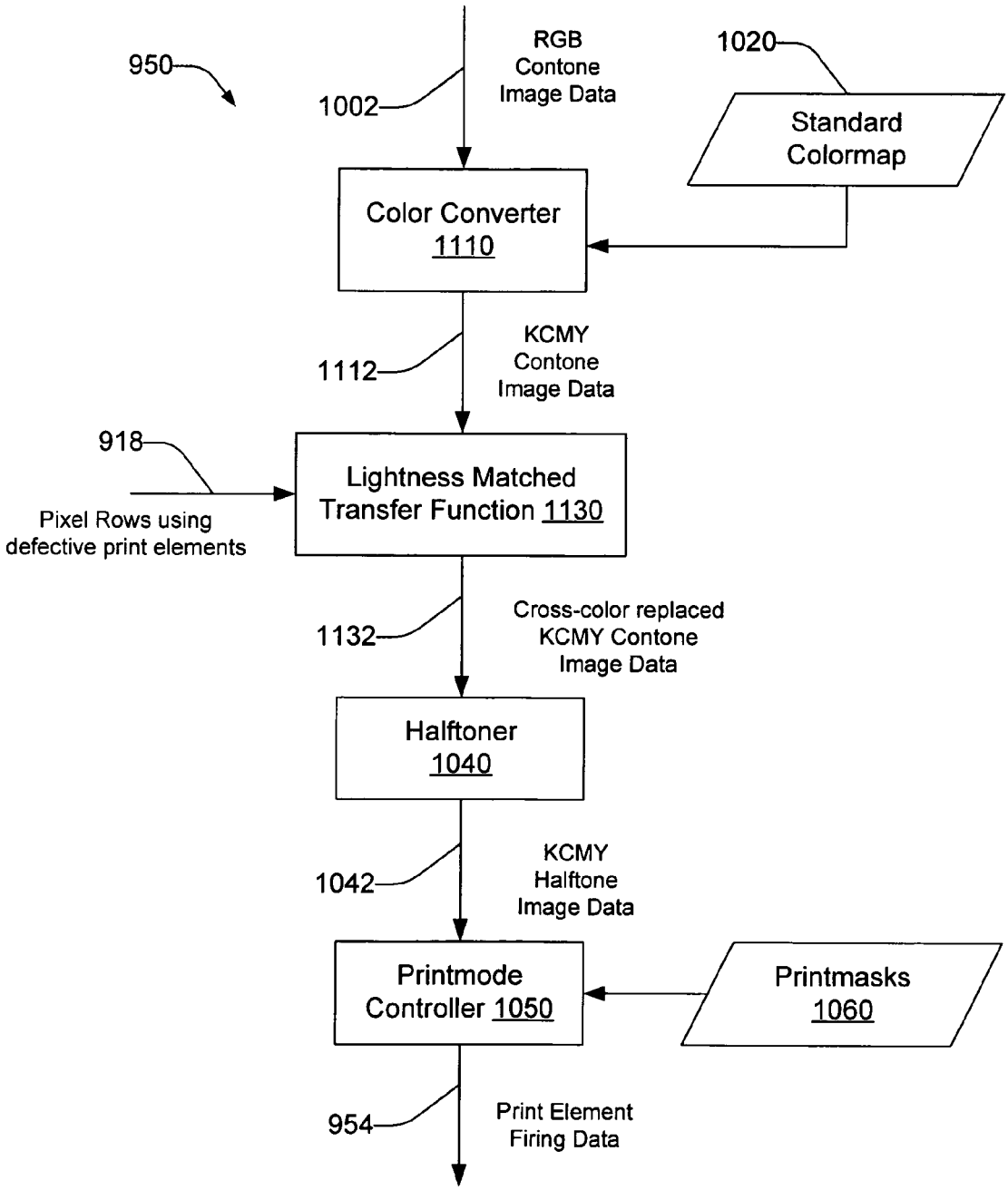
FIG. 11 is a schematic representation of another image data converter usable with the printing system of FIG. 9 in accordance with an embodiment of the present invention.

Considering now in greater detail an alternate embodiment of image data converter 950, and with reference to FIG. 11, color converter 1110 uses only standard colormap 1020 and does not process image data 120 associated with defective print elements differently from data 120 associated with non-defective print elements. Accordingly, color converter 1110 generates KCMY continuous tone data 1112 which is not compensated for defective print elements. A lightness-matched transfer function 1130 receives the identification 918 of the pixel rows that are using defective print elements of a particular color, and uses this information to process the KCMY continuous tone data 1112 so as to generate cross-color replaced KCMY continuous tone data 1132 which is compensated for defective print elements and is substantially equivalent in lightness. The cross-color replaced KCMY continuous tone data 1132 is provided to halftoner 1040 and processing proceeds as has been described heretofore with reference to FIG. 10.

The lightness-matched transfer function 1130 does not convert the data between data formats, but rather retains the current format; for example, the KCMY continuous tone data format. In one embodiment, the lightness-matched transfer function 1130 includes a series of 1-dimensional look up tables (LUTs), one for each color ink in the printing system 900. Through use of one or more of these LUTs, the transfer function 1130, in processing the KCMY continuous tone data 1112 to generate cross-color replaced KCMY continuous tone data 1132 that is substantially equivalent in lightness, can adjust each color component (i.e. K, C, M, and Y) of color data values 820 independently of all the other colorants. Thus a defective print element of a particular color ink (e.g. C) may be compensated for by increasing the level of one or more of the other color components (e.g. K, M, Y) associated with other color inks, for those color data values 820 of KCMY continuous tone data 1112 that are associated with defective print elements.

Figure 12:
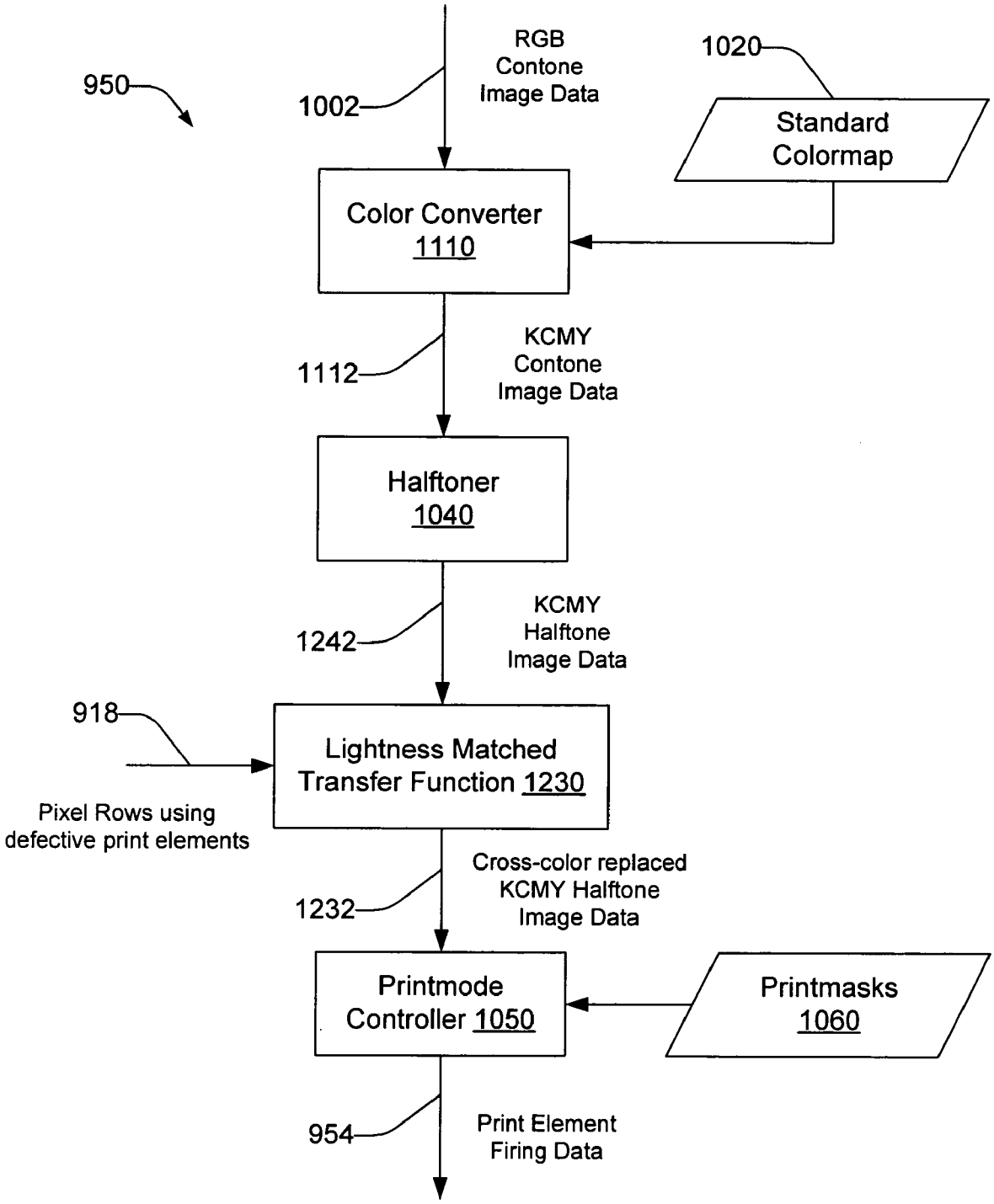
FIG. 12 is a schematic representation of yet another image data converter usable with the printing system of FIG. 9 in accordance with an embodiment of the present invention.

Considering now in greater detail an alternate embodiment of image data converter 950, and with reference to FIG. 12, the KCMY continuous tone data 1112 (not compensated for defective print elements) which is output from color converter 1110 is provided to halftoner 1040 which in turn generates similarly uncompensated KCMY halftone data 1242. A lightness-matched transfer function 1230 receives the identification 918 of the pixel rows that are using defective print elements of a particular color, and uses this information to process the KCMY halftone tone data 1242 so as to generate cross-color replaced KCMY halftone data 1232 which is compensated for defective print elements and is substantially equivalent in lightness. The cross-color replaced KCMY halftone data 1232 is provided to printmode controller 1050 and processing proceeds as has been described heretofore with reference to FIG. 10.

The lightness-matched transfer function 1230 does not convert the data between data formats, but rather retains the current format; for example, the KCMY halftone data format. In one embodiment, the lightness-matched transfer function 1230, in processing the KCMY halftone data 1042 so as to compensate for a defective print element of a particular color ink (e.g. C), may increment the discrete level of one or more of the other color components (e.g. K, M, Y) associated with other color inks, for those color data values 820 of KCMY halftone data 1042 that are associated with the defective print element, so as to increase the number of drops of the other color inks that are emitted. In some embodiments, the lightness-matched transfer function 1230 may be implemented in conjunction with modified printmasks.

While the invention has to this point been described with reference to printer embodiments, it is broadly applicable to embodiments that include a wide variety of image-forming devices in addition to printers. One such image-forming device is a digital light processing (DLP) projector. A DLP projector, as known to those of ordinary skill in the art, includes a digital micromirror device (DMD) having a large number of micron-level mirrors arranged in a two-dimensional array. The DMD can be digitally modulated in accordance with pixel data to precisely direct light from, for example, a six-panel RGB color wheel toward a viewing surface in order to form an image representative of the pixel data. As such, the DLP projector is an additive color device. Certain ones of the mirrors may become defective, and thus these defective imaging elements may adversely affect the quality of the projected image.

Another such image-forming device is a pixel-addressable display. Such displays may use, for example, liquid crystal diode (LCD) technology which controllably allows discrete levels of backlight to pass through the LCD. An LCD display generally includes a two-dimensional array or matrix of LCD pixels. Each pixel typically includes several sub-pixels, each of which is filtered to produce a different color when the backlight passes through. One common arrangement uses three sub-pixels for an RGB color system. Certain ones of the pixels or sub-pixels may become defective, and thus these defective imaging elements may adversely affect the quality of the displayed image.

In one embodiment, the defective imaging elements can be detected, and the pixel data associated with the defective imaging elements identified. The original color value of at least some of the identified pixels can be converted to a replacement color value that is different from, but has substantially the same lightness as, the original color value but which does not utilize the corresponding one of the defective imaging elements. In some embodiments, the original color value and the replacement color value are both expressed in the same color format, which may be RGB.

In another embodiment, adjacent defective imaging elements can be identified. A first defective imaging element compensation operation can be performed for portions of the image data that are associated with a first predetermined number or fewer adjacent defective imaging elements, while a different second defective imaging element compensation operation can be performed for portions of the image data associated a second predetermined number or more adjacent defective print elements.

From the foregoing it will be appreciated that the image forming apparatuses, printers, methods, and processor-readable media provided by the present invention represent a significant advance in the art. Although several specific embodiments of the invention have been described and illustrated, the invention is not limited to the specific methods, forms, or arrangements of parts so described and illustrated. For example, the invention is not limited to applications in drum printers, but can be advantageously used in conjunction with swath printers, where the printing elements reciprocate along one axis while the print medium is advanced along an orthogonal axis. This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Terms of orientation and relative position (such as "top," "bottom," "side," and the like) are not intended to require a particular orientation of the present invention or of any element or assembly of the present invention, and are used only for convenience of illustration and description. Unless otherwise specified, steps of a method claim need not be performed in the order specified. The invention is not limited to the above-described implementations, but instead is defined by the appended claims in light of their full scope of equivalents. Where the claims recite "a" or "a first" element of the equivalent thereof, such claims should be understood to include incorporation of one or more such elements, neither requiring nor excluding two or more such elements.

What is claimed is:

1. A method for forming an image with at least one linear array of imaging elements, comprising:

detecting defective ones of the imaging elements associated with a colorant of a particular color;

performing a first defective imaging element compensation operation using a colorant of the particular color, only for portions of the image data associated with a first predetermined number or fewer adjacent defective imaging elements;

performing a different second defective imaging element compensation operation using at least one colorant of a different color than the particular color, only for portions of the image data associated with a second predetermined number or more adjacent defective print elements.

2. The method of claim 1, wherein the first compensation operation includes providing an increased amount of the colorant of the particular color from non-defective imaging elements adjacent the defective imaging elements.

3. The method of claim 1, wherein the first predetermined number of adjacent defective imaging elements is two and the second predetermined number of adjacent defective imaging elements is three.

4. The method of claim 1 wherein, for each portion of the image data, the first or the second defective imaging element compensation operation is selected based only on the number of adjacent defective imaging elements associated with that portion.

5. The method of claim 1, wherein the first compensation operation provides an increased amount of the colorant of the particular color from non-defective imaging elements adjacent the defective imaging elements, and wherein the different second compensation operation provides a predetermined amount of the at least one colorant of the different color from non-defective imaging elements coincident with the defective print elements.

6. The method of claim 1, wherein the first defective imaging element compensation operation uses only the colorant of the particular color, and wherein the second defective imaging element compensation operation does not use the colorant of the particular color.

7. The method of claim 1, wherein the imaging elements are print elements, and wherein the print elements are associated with the colorant of the particular color.

8. The method of claim 7, wherein the portions of the image data are printed in one of a single pass, or multiple passes without indexing such that each print element prints a same portion of the image data during each of the multiple passes.

9. The method of claim 1, wherein the different second compensation operation includes providing a predetermined amount of the at least one colorant of the different color from non-defective imaging elements coincident with the defective print elements.

10. The method of claim 9, wherein the predetermined amount of the at least one colorant of the different color produces imaging output that is substantially equivalent in lightness to imaging output produced by a corresponding predetermined amount of the colorant of the particular color.

11. The method of claim 10, wherein the imaging output is further substantially equivalent in color to the imaging output produced by a corresponding predetermined amount of the colorant of the particular color.

12. The method of claim 9, wherein the different second compensation operation includes colormapping at least some pixels of the portions of the image data from an original color value to a replacement color value that does not require the particular color.

13. The method of claim 12, wherein the original color value and the replacement color value are expressed in an RGB color format.

14. A printer for printing color image data, comprising:

an array of print elements positionable at a fixed location relative to rows of a print medium during a printing pass to emit a particular colored fluid;

a print element quality detector configured to identify defective ones of the print elements;

a mapper configured to map the defective print elements to corresponding rows of pixels of the image data;

first means for processing the image data so as to compensate, with the particular colored fluid, only for first ones of the corresponding rows of pixels associated with a first predetermined number or fewer adjacent defective print elements; and second means for processing the image data so as to compensate, with at least one different colored fluid, only for second ones of the corresponding rows of pixels associated with a second predetermined number or more adjacent defective print elements.

15. The printer of claim 14, wherein the first means includes means for ejecting an increased amount of the particular colored fluid from non-defective print elements adjacent the defective print elements.

16. The printer of claim 14, wherein the second means includes means for ejecting a predetermined amount of at least one different colored fluid from non-defective print elements coincident with the defective print elements.

17. The printer of claim 14, wherein the first predetermined number of adjacent defective print elements is two and the second predetermined number of adjacent defective print elements is three.

18. The printer of claim 14, wherein the first or the second processing means is selected for processing the image data based only on the number of adjacent defective imaging elements associated with the corresponding row of pixels.

19. The printer of claim 14, wherein the second means includes means for converting an initial color value of each of the second ones of the corresponding rows of pixels to a replacement color value different from, but having substantially a same lightness as, the initial color value and which does not utilize the corresponding defective print element.

20. The printer of claim 19, wherein the replacement color value has substantially the same color as the initial color value.

21. The printer of claim 19, wherein the means for converting includes a color converter that converts the initial color value in a first continuous-tone format to the replacement color value in a second continuous-tone format via a replacement color map different from a standard color map.

22. The printer of claim 19, wherein the means for converting includes a lightness-matched transfer function that converts the initial color value in a first continuous-tone format to the replacement color value in the first continuous-tone format.

23. The printer of claim 19, wherein the means for converting includes a lightness-marched transfer function that converts the initial color value in a halftone format to the replacement color value in the halftone format.

24. A processor-readable medium having processor-executable instructions thereon which, when executed by a processor, cause the processor to:

detect detective ones of print elements associated with a particular colored fluid;

configure an image pipeline to perform a first defective print element compensation operation using the particular colored fluid, only for portions of image data associated with a first predetermined number or fewer adjacent defective print elements; and configure the image pipeline to perform a different second defective print element compensation operation using at least one different colored fluid but not the particular colored fluid, only for portions of the image data associated with a second predetermined number or more adjacent defective print elements.

25. The medium of claim 24, wherein the first defective print element compensation operation ejects an increased amount of the particular colored fluid from non-defective print elements adjacent the defective print elements.

26. The medium of claim 24, wherein the second defective print element compensation operation ejects a predetermined amount of the at least one different colored fluid from print elements coincident with the defective print elements.

27. The medium of claim 24 wherein, for each portion of the image data, the first or the second defective print element compensation operation is selected based only on the number of adjacent defective print elements associated with that portion.

28. The medium of claim 24, wherein the first predetermined number of adjacent defective print elements is two and the second predetermined number of adjacent defective print elements is three.

* * * * *

UNITED STATES PATENT AND TRADEMARK OFFICE

CERTIFICATE OF CORRECTION

PATENT NO. : 7,673,958 B2
APPLICATION NO. : 11/157724
DATED : March 9, 2010
INVENTOR(S) : Heiles et al.

It is certified that error appears in the above-identified patent and that said Letters Patent is hereby corrected as shown below:

In column 16, line 26, in Claim 23, delete "lightness-marched" and insert -- lightness-matched --, therefor.

In column 16, line 32, in Claim 24, delete "detective" and insert -- defective --, therefor.

Signed and Sealed this

Ninth Day of November, 2010

David J. Kappos

David J. Kappos
*Director of the United States Patent and Trademark Office*